US009915508B2

(12) United States Patent
Moore et al.

(10) Patent No.: US 9,915,508 B2
(45) **Date of Patent: *Mar. 13, 2018**

(54) LASER TRAINER TARGET

(71) Applicants: Larry Moore, Cottonwood, AZ (US); Aaron Moore, Cottonwood, AZ (US)

(72) Inventors: Larry Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/955,440

(22) Filed: Dec. 1, 2015

(65) Prior Publication Data

US 2016/0305748 A1 Oct. 20, 2016

Related U.S. Application Data

(63) Continuation of application No. 13/353,241, filed on Jan. 18, 2012, now Pat. No. 9,429,404.

(60) Provisional application No. 61/433,902, filed on Jan. 18, 2011.

(51) Int. Cl.

| | |
|---|---|
| ***F41A 33/02*** | (2006.01) |
| ***F41J 5/02*** | (2006.01) |
| ***F41G 1/54*** | (2006.01) |
| ***F41G 1/32*** | (2006.01) |
| ***F42B 8/02*** | (2006.01) |
| ***F42B 12/42*** | (2006.01) |

(52) U.S. Cl.
CPC *F41J 5/02* (2013.01); *F41G 1/32* (2013.01); *F41G 1/54* (2013.01); *F42B 8/02* (2013.01); *F42B 12/42* (2013.01)

(58) Field of Classification Search
CPC ..... F41A 33/02
USPC ..... 434/21
See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

EPO; Office Action dated Oct. 5, 2011 in Serial No. 09169459.

(Continued)

*Primary Examiner* — Thomas Hong

(74) *Attorney, Agent, or Firm* — Snell & Wilmer LLP

(57) ABSTRACT

A target senses whether and where it has been struck by a laser light. The target includes a screen for allowing laser light to pass through, a plurality of light sensors behind the screen, and an optical display associated with one or more of the light sensors. When the target is struck by a laser light, a sensor records the strike, and the target may be struck with laser light multiple times, whereby different sensors may record the different strikes. To determine whether and where the target has been struck, the user activates a display mode that causes the optical displays in the target to illuminate. The user can then reset the target so the user can begin again.

44 Claims, 19 Drawing Sheets

(56) References Cited

U.S. PATENT DOCUMENTS 2,826,848 A 3/1958 Davies
2,844,710 A 7/1958 Rudolf
2,904,888 A 9/1959 Niesp
3,104,478 A 9/1963 Strauss
3,112,567 A 12/1963 Flanagan
3,192,915 A 7/1965 Norris et al.
3,284,905 A 11/1966 Simmons
3,510,965 A 5/1970 Rhea
3,526,972 A 9/1970 Sumpf
3,573,868 A 4/1971 Giannetti
3,618,673 A 11/1971 Gossett
3,633,285 A 1/1972 Sensney
3,641,676 A 2/1972 Knutsen et al.
3,645,635 A 2/1972 Steck
3,748,751 A 7/1973 Breglia
3,801,205 A 4/1974 Eggenschwyler
3,813,795 A 6/1974 Marshall
3,914,873 A 10/1975 Elliot, Jr. et al.
3,948,522 A 4/1976 Fixler
3,992,783 A 11/1976 Dunlap et al.
3,995,376 A 12/1976 Kimble et al.
4,026,054 A 5/1977 Snyder
4,048,489 A 9/1977 Giannetti
4,063,368 A 12/1977 McFarland
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,352,665 A 10/1982 Kimble et al.
4,452,458 A 6/1984 Timander
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallaher
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,235 A 1/1993 Toole
5,194,007 A 3/1993 Marshall
5,208,826 A 5/1993 Kelly
5,179,124 A 6/1993 Schoenwald et al.
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,488,795 A 2/1996 Sweat
D368,121 S 3/1996 Lam
5,509,226 A 4/1996 Houde-Walter
5,499,455 A 5/1996 Palmer
5,515,636 A 5/1996 McGarry et al.
5,481,819 A 6/1996 Teetzel
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A 2/1997 Seeton
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A * 2/1998 O'Loughlin ..... F41J 5/02 273/365
5,735,070 A 4/1998 Vasquez et al.
5,787,631 A 8/1998 Kendall
5,788,500 A 8/1998 Gelber
5,822,905 A 10/1998 Teazel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 * 9/2001 Kwan ..... A63F 9/0291 273/371
6,295,753 B1 10/2001 Thummel
6,301,046 B1 10/2001 Tai et al.

(56) References Cited

U.S. PATENT DOCUMENTS 6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,614,510 B1 9/2003 Rogers et al.
6,616,452 B2 9/2003 Clark et al.
6,622,414 B1 9/2003 Oliver et al.
6,631,580 B2 10/2003 Lafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,749,075 B2 6/2004 Bourque
6,782,789 B2 8/2004 McNulty
6,804,907 B1 10/2004 Slobodkin
6,843,478 B1 1/2005 Hoepelman
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 9/2005 Isoz
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang
RE40,429 E 7/2008 Oliver et al.
D578,599 S 10/2008 Cheng
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese
8,104,220 B2 1/2012 Cobb
D653,798 S 2/2012 Janice et al.
8,109,024 B2 2/2012 Abst
8,110,760 B2 2/2012 Sharrah et al.
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,151,504 B1 4/2012 Aiston
8,151,505 B2 4/2012 Thompson
8,166,694 B2 5/2012 Swan
8,172,139 B1 5/2012 McDonald et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.

(56) References Cited

U.S. PATENT DOCUMENTS

D674,862 S 1/2013 Johnston et al.
D675,281 S 1/2013 Speroni
8,341,868 B2 1/2013 Zusman
8,347,541 B1 1/2013 Thompson
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,919,023 B2 12/2014 Merritt et al.
8,927,083 B2 1/2015 Pell
8,938,904 B1 1/2015 Sellers et al.
D722,125 S 2/2015 Zayatz
8,944,838 B2 2/2015 Mulfinger
9,023,459 B2 5/2015 Hogue
9,146,077 B2 9/2015 Moore
9,182,194 B2 11/2015 Moore
9,188,407 B2 11/2015 Moore
9,272,402 B2 3/2016 Hu
9,297,614 B2 3/2016 Moore
9,644,826 B2 5/2017 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0129536 A1 9/2002 Iafrate et al.
2002/0134000 A1 9/2002 Varshneya et al.
2002/0194767 A1 12/2002 Houde Walter et al.
2003/0003424 A1 1/2003 Shechter et al.
2003/0029072 A1 3/2003 Danielson
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 4/2004 Luke
2005/0044736 A1 3/2005 Liao
2005/0130739 A1 6/2005 Argentar
2005/0153262 A1* 7/2005 Kendir ..... F41G 3/2655 434/21
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0229448 A1 9/2010 Houde-Walter
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0162249 A1 7/2011 Woodmansee et al.
2011/0185619 A1 8/2011 Finnegan et al.
2012/0005938 A1 1/2012 Sloan
2012/0047787 A1 3/2012 Curly
2012/0055061 A1 3/2012 Hartley et al.
2012/0110886 A1 5/2012 Moore et al.
2012/0124885 A1 5/2012 Caulk et al.
2012/0144716 A1 6/2012 Cabahug et al.
2012/0180366 A1 7/2012 Jaroh et al.
2012/0180367 A1 7/2012 Singh
2012/0180370 A1 7/2012 McKinley
2012/0224357 A1 9/2012 Moore
2013/0185978 A1 7/2013 Dodd et al.
2013/0185982 A1 7/2013 Hilbourne et al.
2013/0205635 A1 8/2013 Hines
2013/0263492 A1 10/2013 Erdle
2013/0318851 A1 12/2013 Diamond
2014/0007485 A1 1/2014 Castejon
2014/0109457 A1 4/2014 Speroni
2014/0355258 A1 12/2014 Izumi et al.
2015/0283459 A1 10/2015 Condon
2015/0308670 A1 10/2015 Moore
2015/0345905 A1 12/2015 Hancosky
2015/0348330 A1 12/2015 Balachandreswaran
2016/0059136 A1 3/2016 Ferris
2016/0084618 A1 3/2016 Hong
2016/0091285 A1 3/2016 Mason
2016/0161220 A1 6/2016 Moore
2016/0245617 A1 8/2016 Moore
2016/0361626 A1 12/2016 Moore
2017/0003103 A1 1/2017 Moore
2017/0082399 A1 3/2017 Moore

(56) References Cited

U.S. PATENT DOCUMENTS

2017/0153095 A1 6/2017 Moore
2017/0160054 A1 6/2017 Moore

OTHER PUBLICATIONS

EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 09169469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.

(56) References Cited

OTHER PUBLICATIONS

USPTO; Notice of Allowance dated Jun. 24, 2015 in U.S. Appl. No. 14/316,688.
USPTO; Office Action dated Mar. 3, 2015 in U.S. Appl. No. 14/278,315.
Uspto; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
USPTO; Notice of Allowance dated Nov. 15, 2016 in U.S. Appl. No. 14/630,467.
UPSTO; Non-Final Office Action dated Oct. 6, 2016 in U.S. Appl. No. 15/243,813.
USPTO; Office Action dated Feb. 24, 2017 in U.S. Appl. No. 15/166,145.
USPTO; Notice of Allowance dated Mar. 7, 2017 in U.S. Appl. No. 14/630,467.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.annorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Notice of Allowance dated Apr. 26, 2017 in U.S. Appl. No. 15/130,744.
USPTO; Final Office Action dated May 18, 2017 in U.S. Appl. No. 15/243,813.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.
UPSTO; Notice of Allowance and Fees Due dated Jul. 11, 2017 in U.S. Appl. No. 15/130,744.
USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.

* cited by examiner

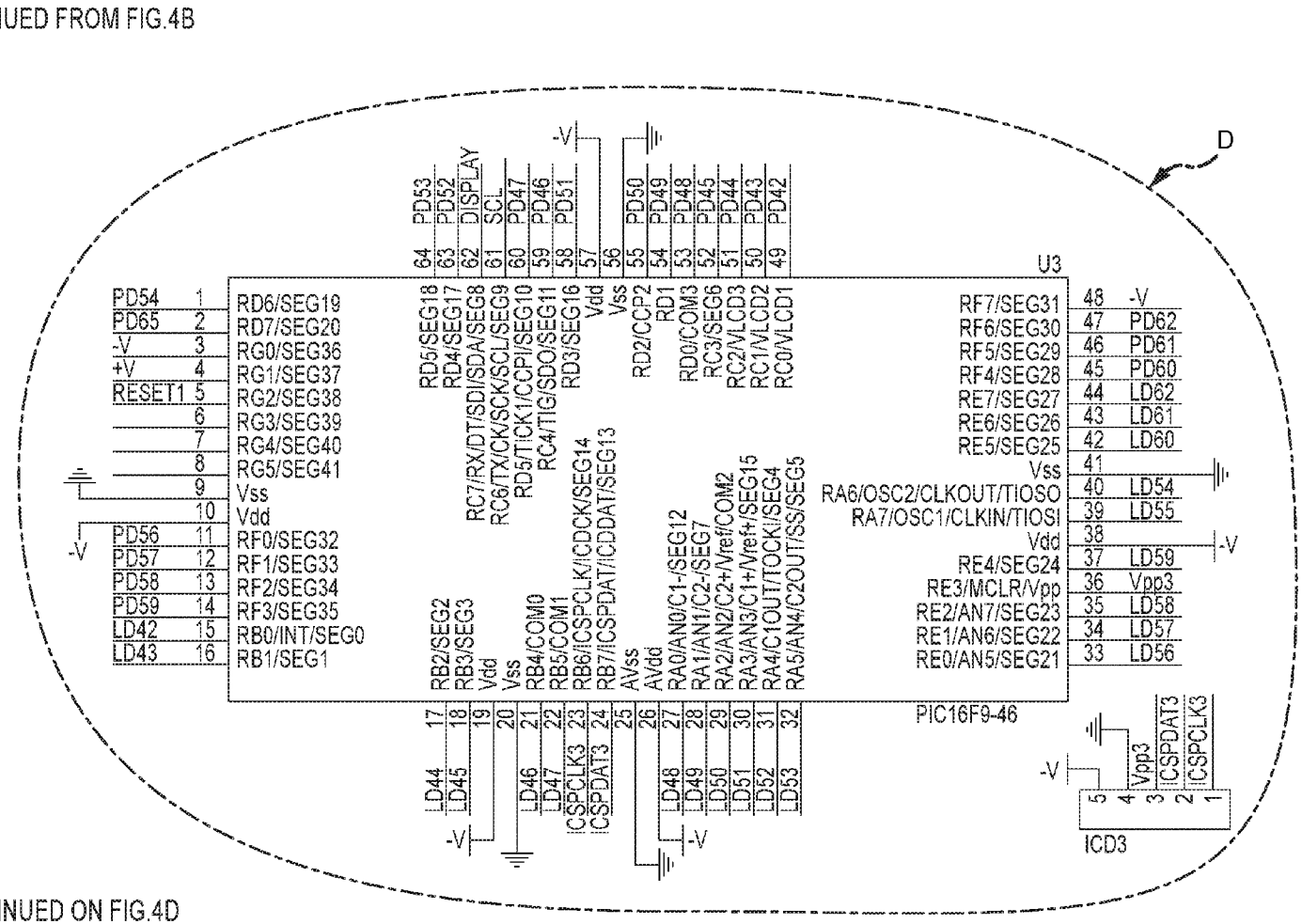
FIG. 4C
CONTINUED FROM FIG.4B
CONTINUED ON FIG.4D
CONTINUED ON FIG.4F

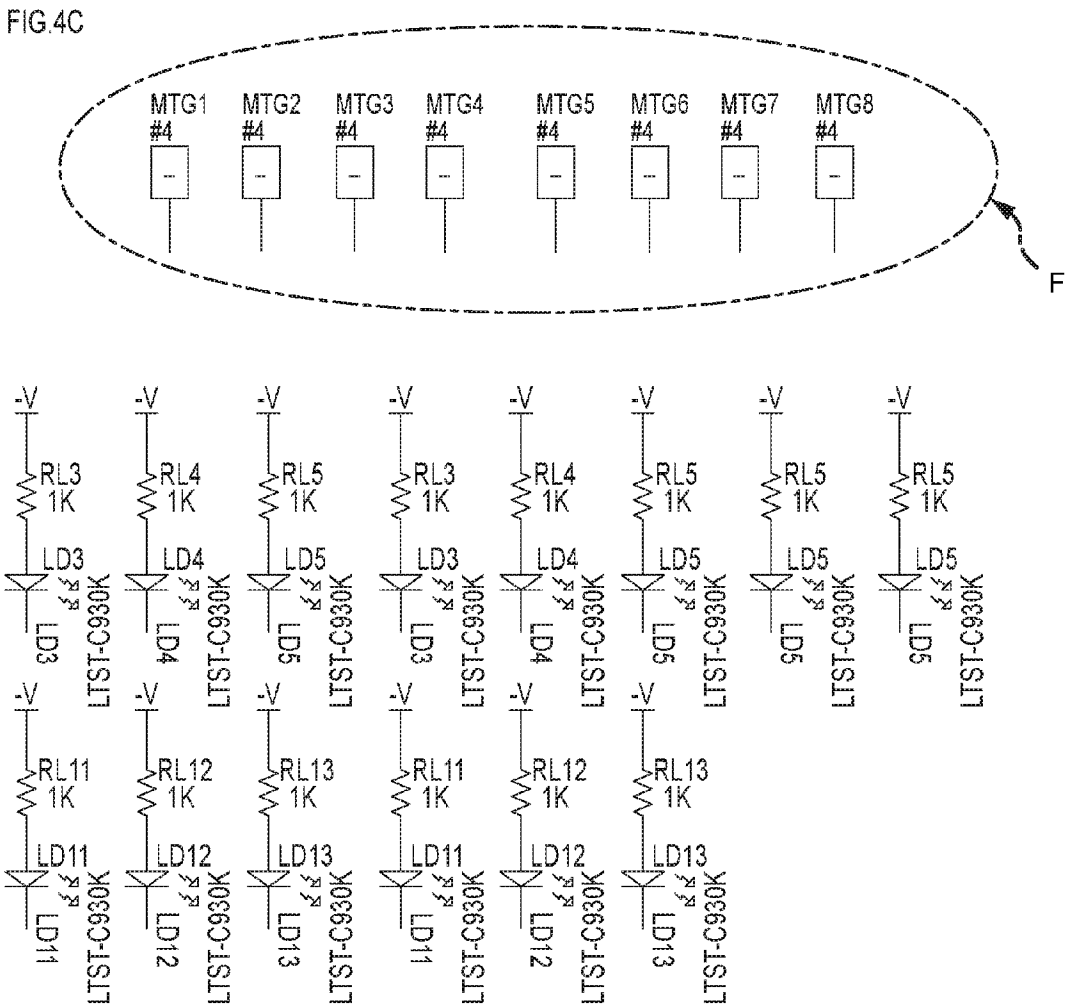
FIG. 4D
CONTINUED FROM FIG.4C
CONTINUED ON FIG.4G

CONTINUED FROM FIG.4A

CONTINUED ON FIG.4H

CONTINUED FROM FIG.4D
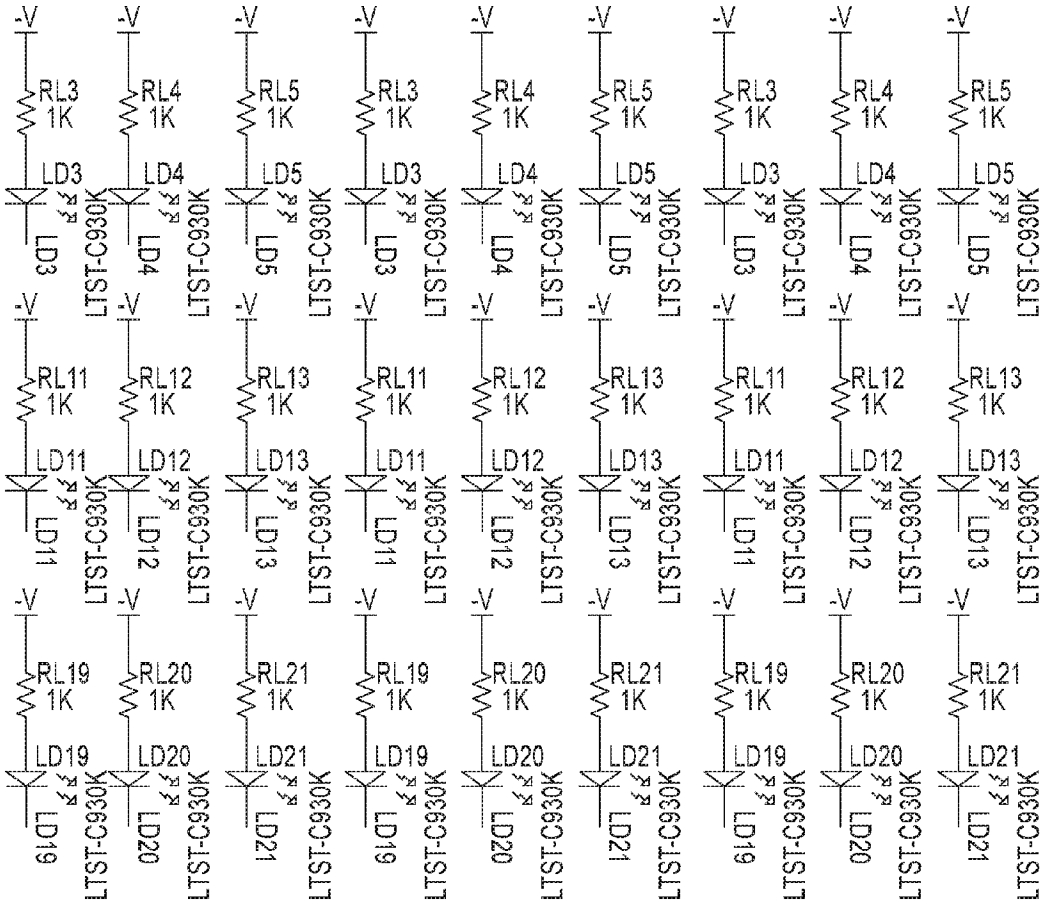
FIG. 4G
CONTINUED FROM FIG.4F
CONTINUED ON FIG.4J

CONTINUED FROM FIG.4E

CONTINUED FROM FIG.4G
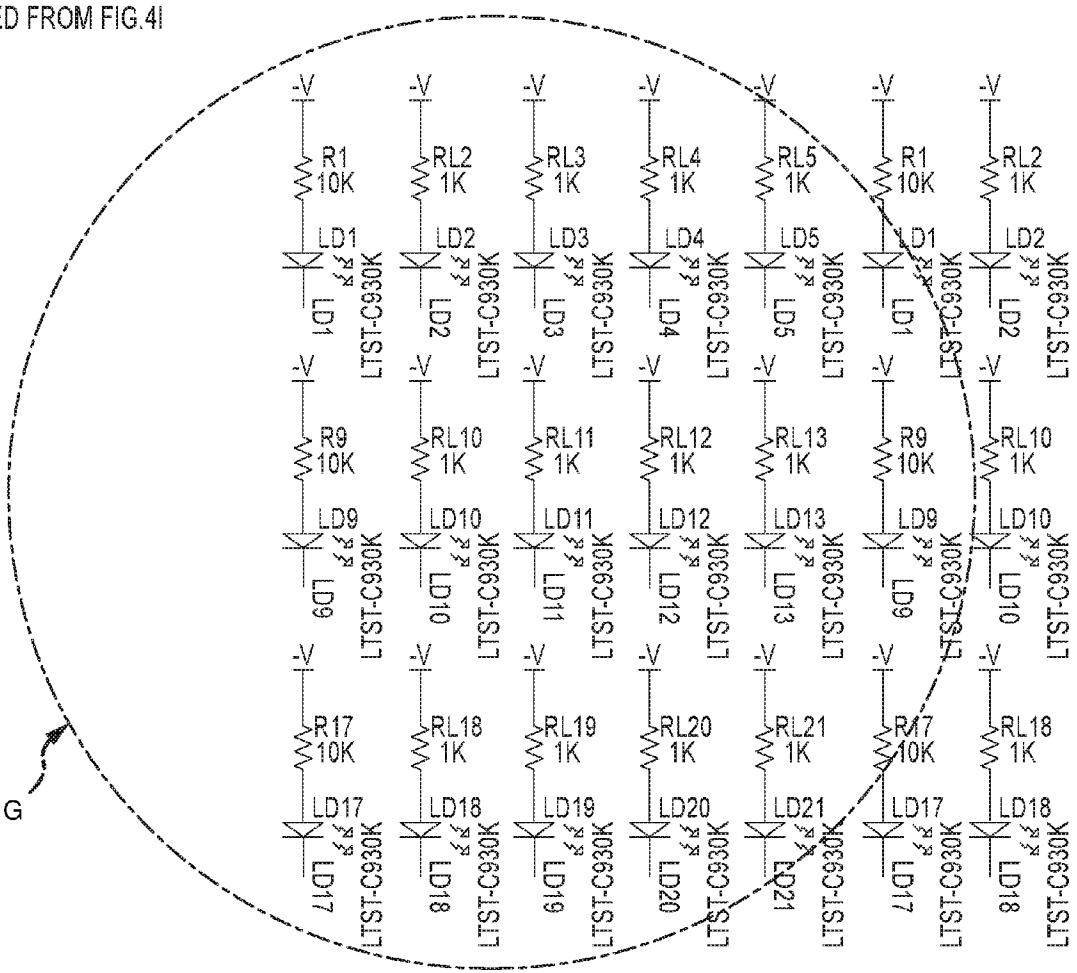
FIG. 4J
CONTINUED FROM FIG.4I

LASER TRAINER TARGET

CROSS REFERENCE TO RELATED APPLICATIONS

This application is a continuation of U.S. application Ser. No. 13/353,241, entitled LASER TRAINER TARGET, filed on Jan. 18, 2012 and claims priority to and incorporates by reference the disclosure of U.S. Provisional Patent Application No. 61/433,902 entitled LASER TRAINER CARTRIDGE AND LASER TRAINER TARGET, filed on Jan. 18, 2011. The disclosure of co-pending U.S. application Ser. No. 13/353,165 entitled "Laser Trainer Cartridge" to Larry E. Moore, filed on Jan. 18, 2012 is incorporated herein by reference.

FIELD OF THE INVENTION

The present invention relates to firearm training systems that do not require live ammunition.

SUMMARY OF THE INVENTION

Conventional firearms training can be dangerous, expensive (considering the prices for ammunition and replacement targets) and can only be performed in certain areas, such as shooting ranges. The present invention allows firearm training to be performed safely, inexpensively, and almost anywhere without the use of live ammunition.

A laser trainer target according to aspects of the invention records where a laser light (such as the laser emitted from a laser trainer cartridge) hits the target. Among other things, the laser trainer target (or "target") can help save time, money and ammunition (which is itself expensive), and can help users learn or teach shooting skills, preferably including unsighted fire, accuracy, grouping and trigger control. The laser trainer target helps users to practice shooting skills in a wide range of locations.

The laser trainer target displays hits from laser light when the target is activated to be in the display mode. In one embodiment, a user "shoots" laser light at the target and, to display the hits to the target, shoots and strikes a "display" area on the face of the laser trainer target with laser light. When the user is finished training, he/she simply strikes a "reset" area of the target with laser light, which resets the target so it no longer registers laser light strikes that occurred before the target was reset.

The laser trainer target provides a convenient, easy-to use, and inexpensive firearms training option, and operates without the need for an external computer, television or projector. In alternate embodiments, however, a target of the present invention may be configured to interface with any desired device, such as a computer system, printer, and/or display. In this way, users can, among other things, compare their scores against one another and print out paper hardcopies of their targets (showing, for example, simulated bullet holes) just as they would have at an actual shooting range.

DETAILED DESCRIPTION OF THE INVENTION

Figure 1:
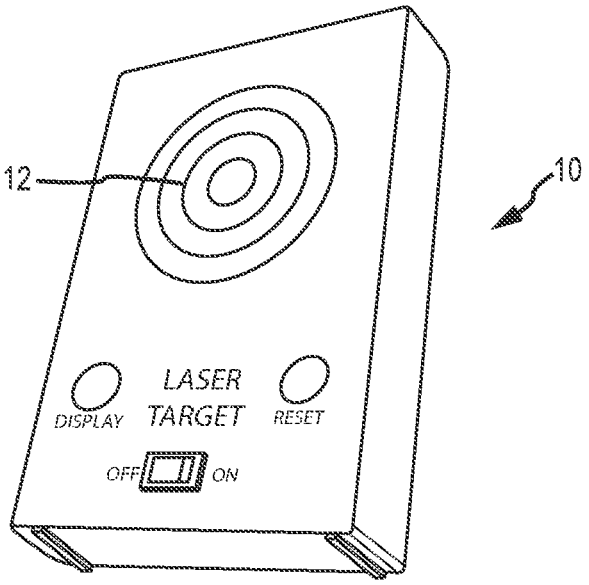
FIGS. 1 and 2 are perspective and frontal views of a laser trainer target according to aspects of the present invention.
Figure 2:
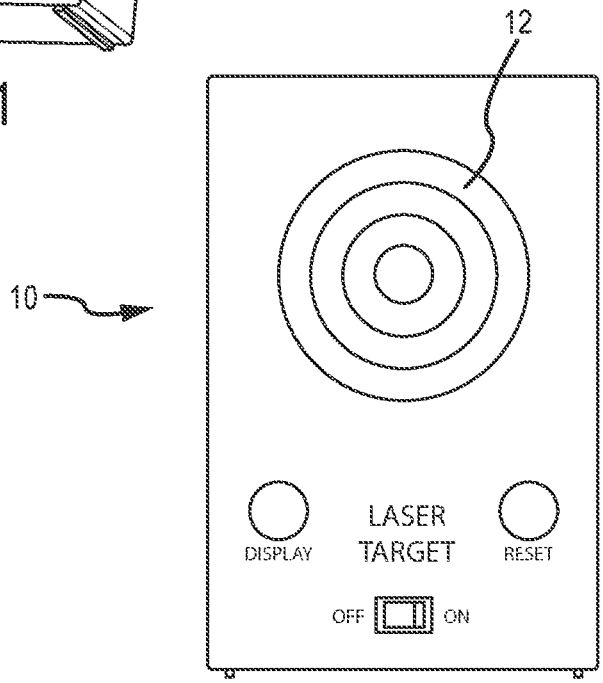

Turning now to the figures, where the purpose is to describe a preferred embodiment of the invention and not to limit same, FIGS. 1 and 2 are perspective and frontal views, respectively, of an exemplary embodiment of a laser trainer target 10 according to various aspects of the invention. The target 10 includes a screen 12 (circular with a bullseye pattern in this embodiment) that allows laser light to pass through it. Behind the screen are a plurality of sensors (e.g., phototransistors) configured to detect when it has been exposed to laser light, and an optical display (e.g., a light-emitting diode) associated with each of the sensors capable of showing where the laser light struck the target when activated.

Figure 3:
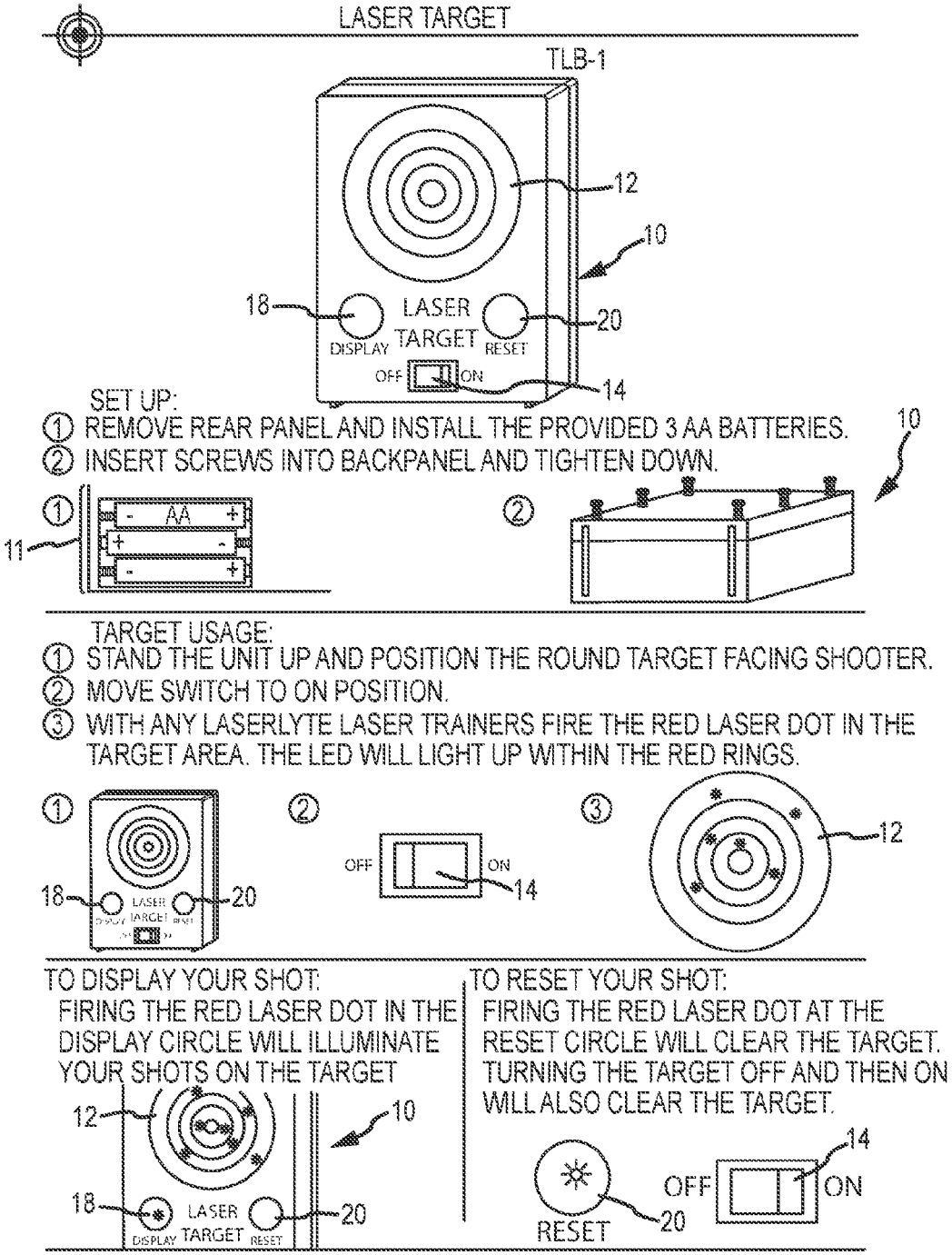
FIG. 3 illustrates various aspects of the target in FIGS. 1 and 2, including how the back of the target can be removed to insert or replace batteries, how the target is used, how impacts of laser light on the target are displayed, and how the target is reset.

The operation of the target of FIGS. 1 and 2 is further shown in FIG. 3. As shown in FIG. 3, the target is battery-powered (using three "AA" batteries) 11, although any suitable power source may be utilized, such as electricity from an outlet in a home, and includes a manual on-off switch 14. This exemplary target 10 also includes a display area 18 and a reset area 20. When the display area 18 is illuminated (or "struck") by a laser light, it activates the display mode, which illuminates the optical display(s) D to indicate where the target 10 was previously struck by laser light. When the reset area 20 is illuminated by laser light, each sensor S that was struck by laser light is reset and each optical display D is turned off. The sensors S are not activated again until struck again by laser light. In this manner, the target 10 can be used and reset over and over.

In this embodiment, the laser trainer target 10 gives the user delayed shooting feedback, so the shooter can concentrate on the next shot instead of visually seeing where the last shot struck. In this embodiment, the three AA batteries 11 can sense and register about 6,000 hits (or "strikes"), and target 10 can sense and register hits by a laser of up to 50 yards away. In alternate embodiments, hits may be displayed as soon as they are registered, and/or the "display," "reset," and "on/off" functions of the target 10 may be controlled via a remote control in communication with the target through a wired or wireless interface.

Figure 4A:
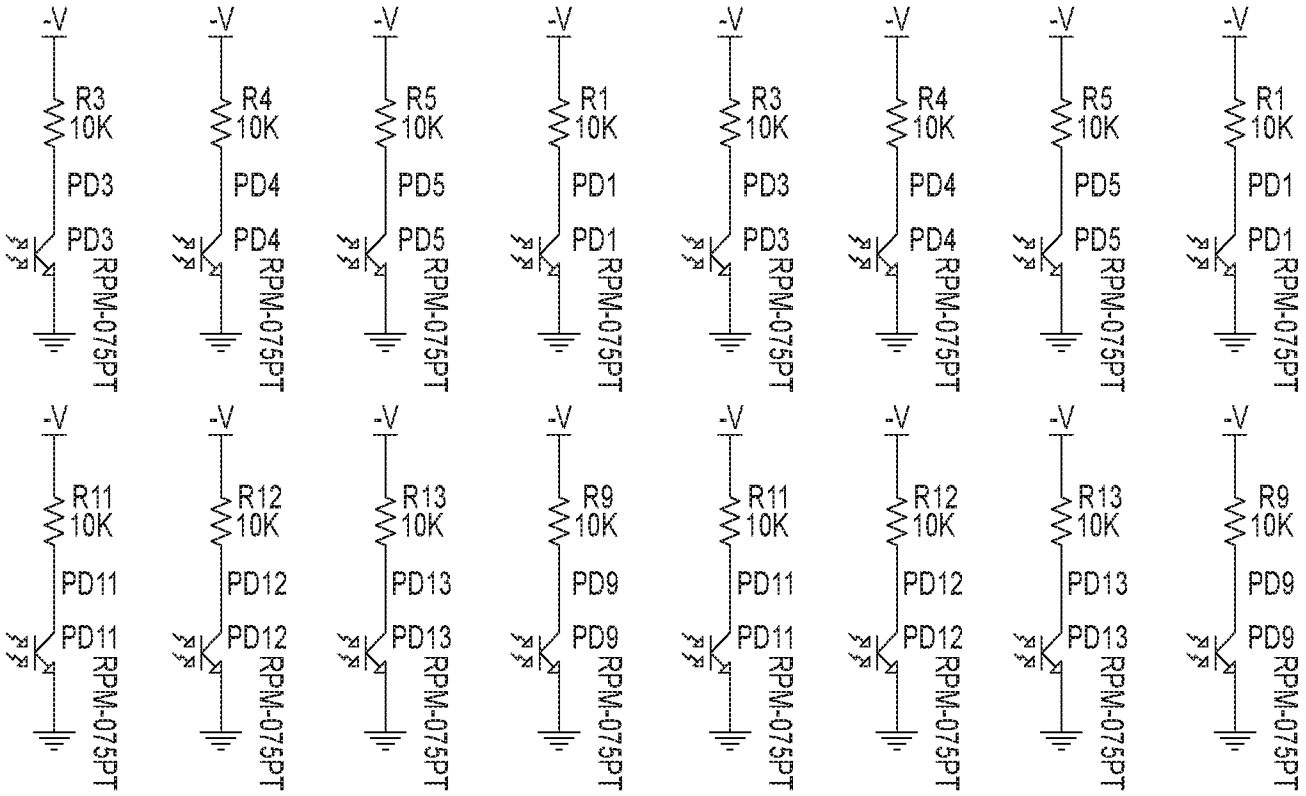
FIGS. 4A-AJ schematically illustrate components in an exemplary laser training target according to various aspects of the invention.
Figure 4B:
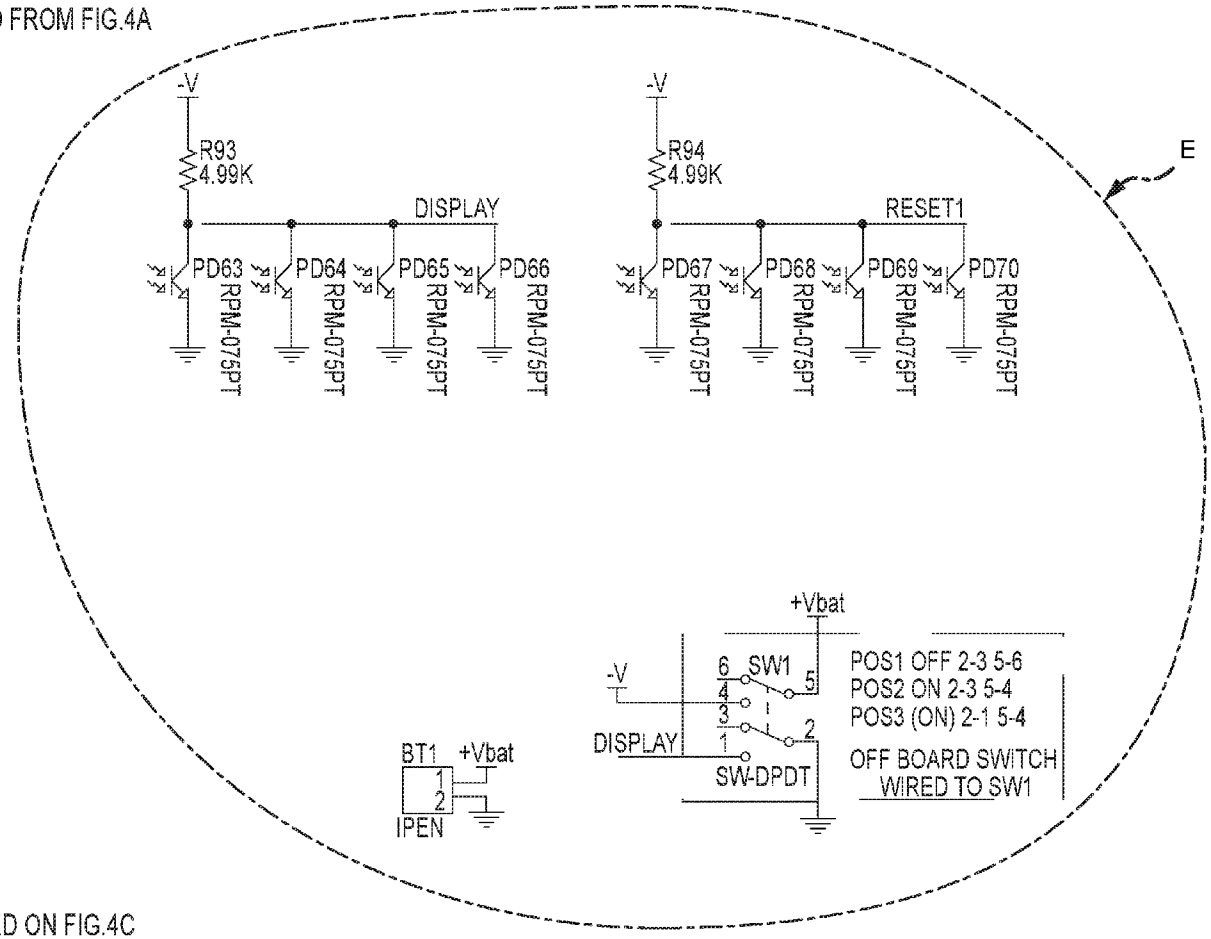
Figure 4E:
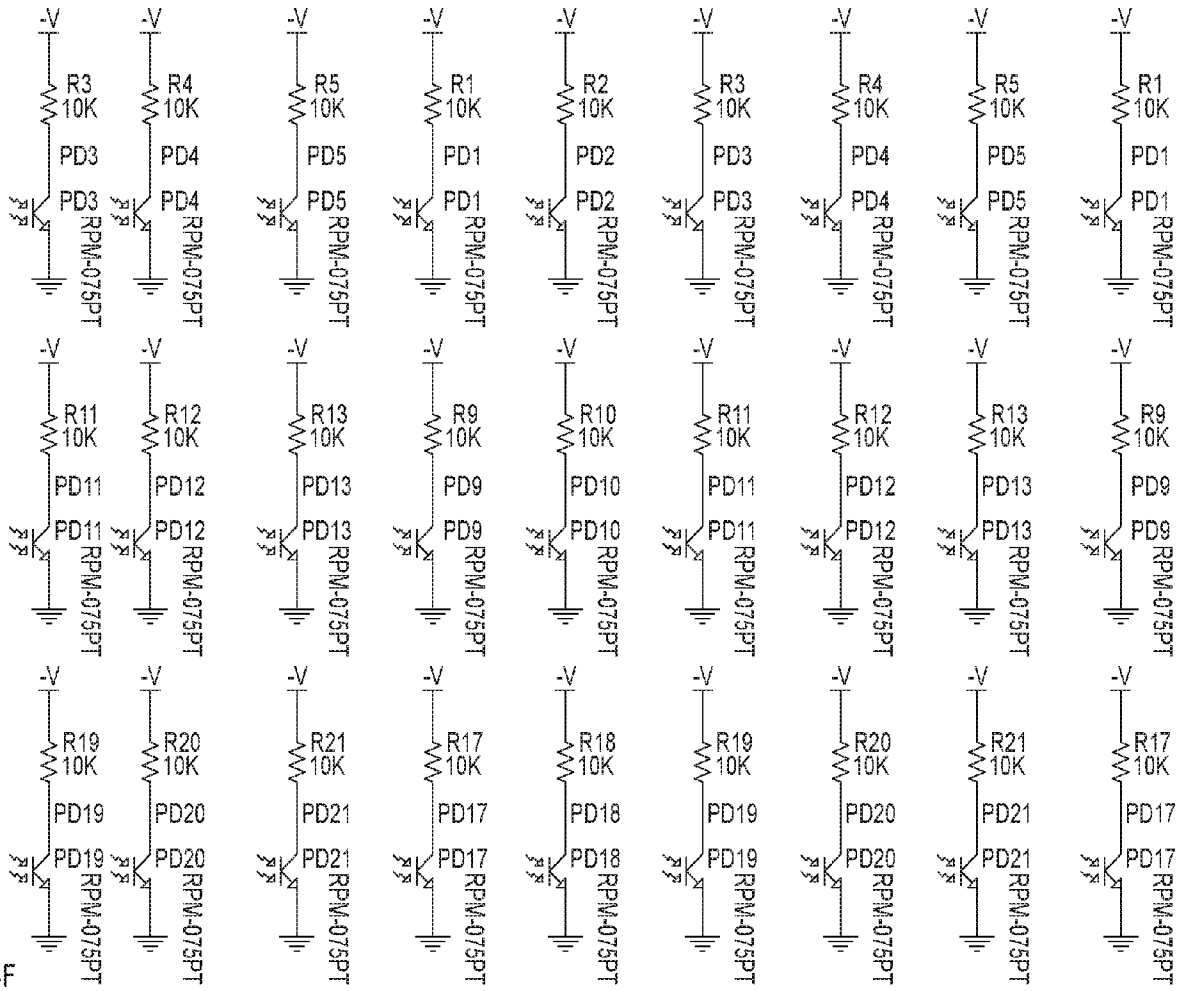
Figure 4F:
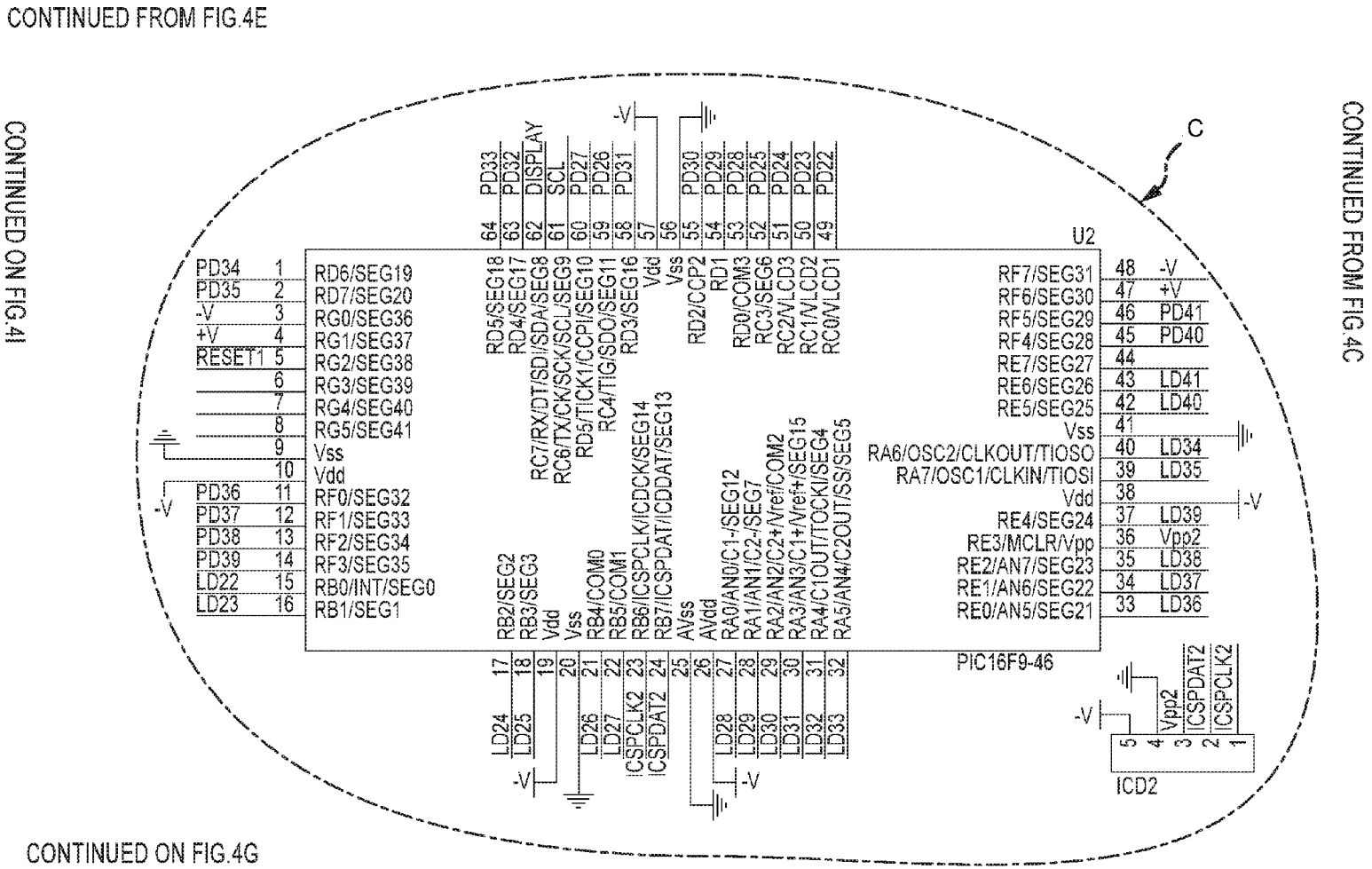
Figure 4H:
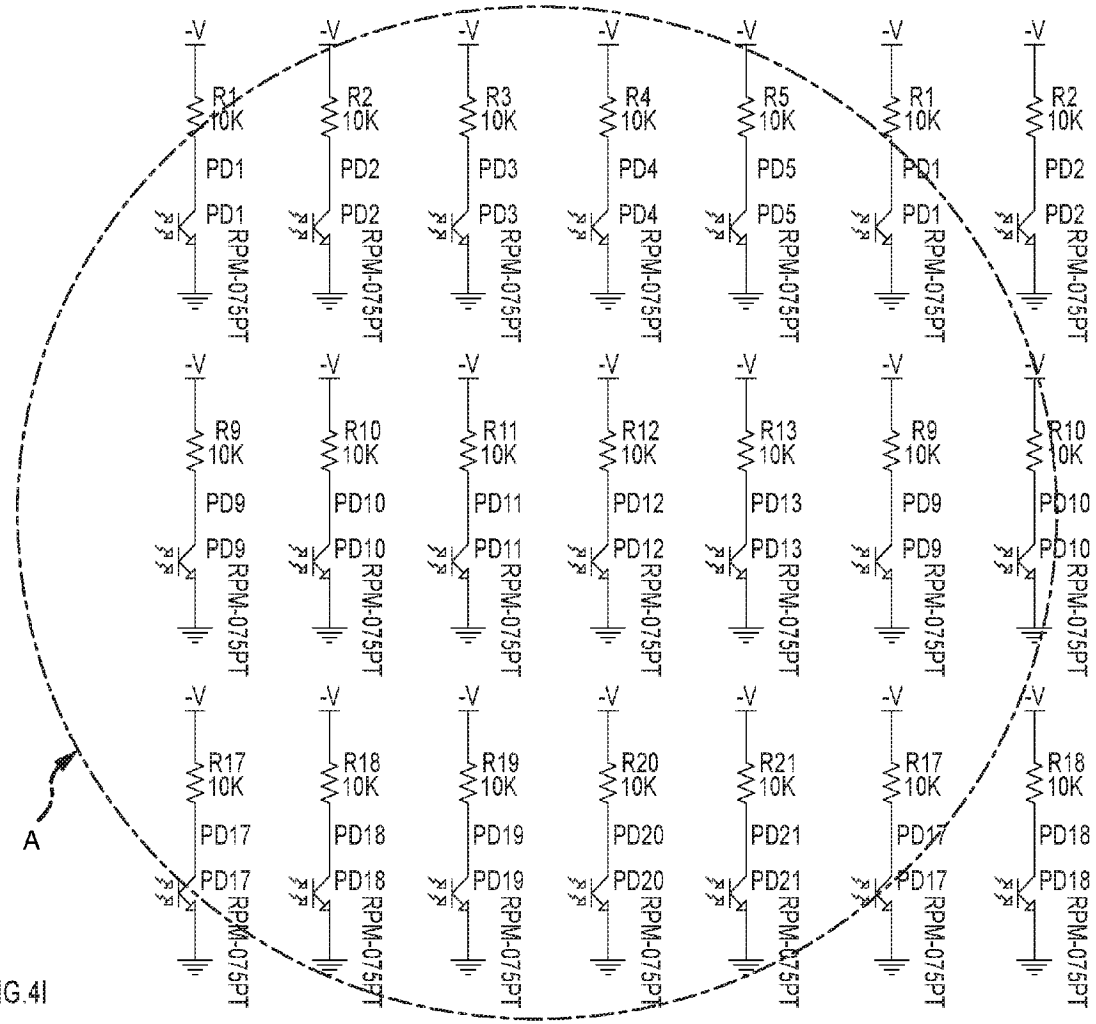
Figure 4I:
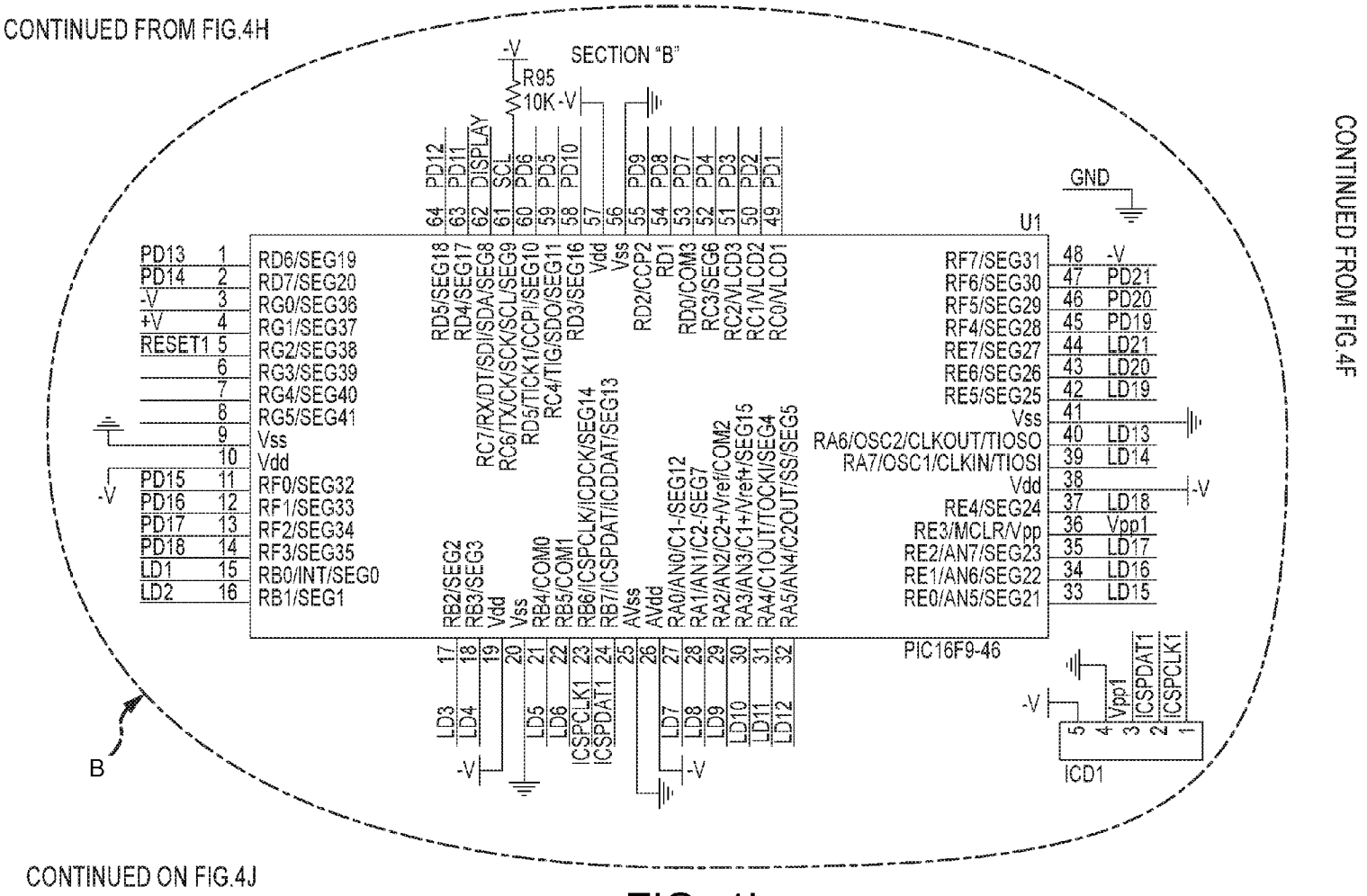
Figure 5:
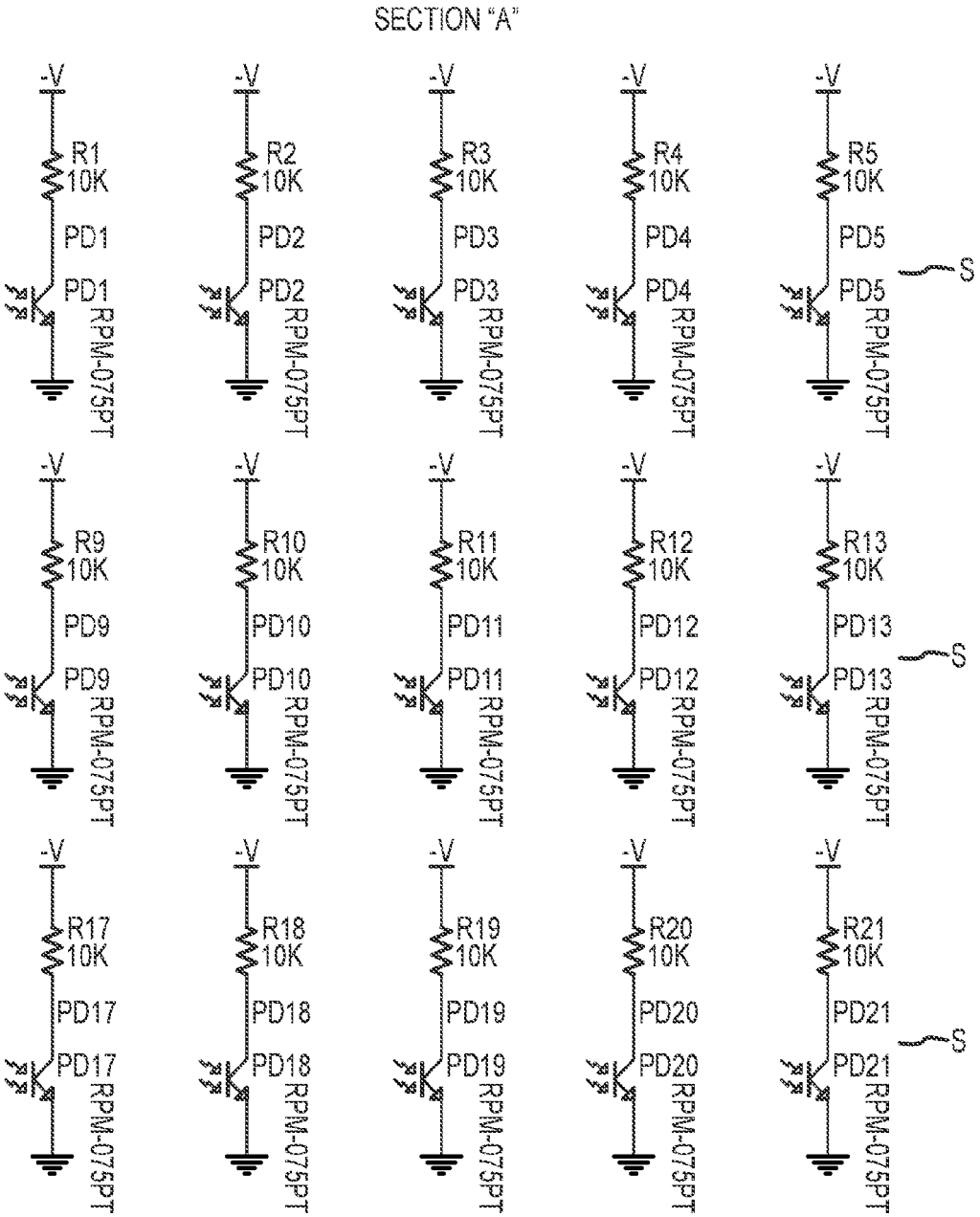
FIG. 5 is a close-up view of section "A" in FIG. 4H, showing the circuit diagrams for a portion of the sensors used in the laser training target.
Figure 6:
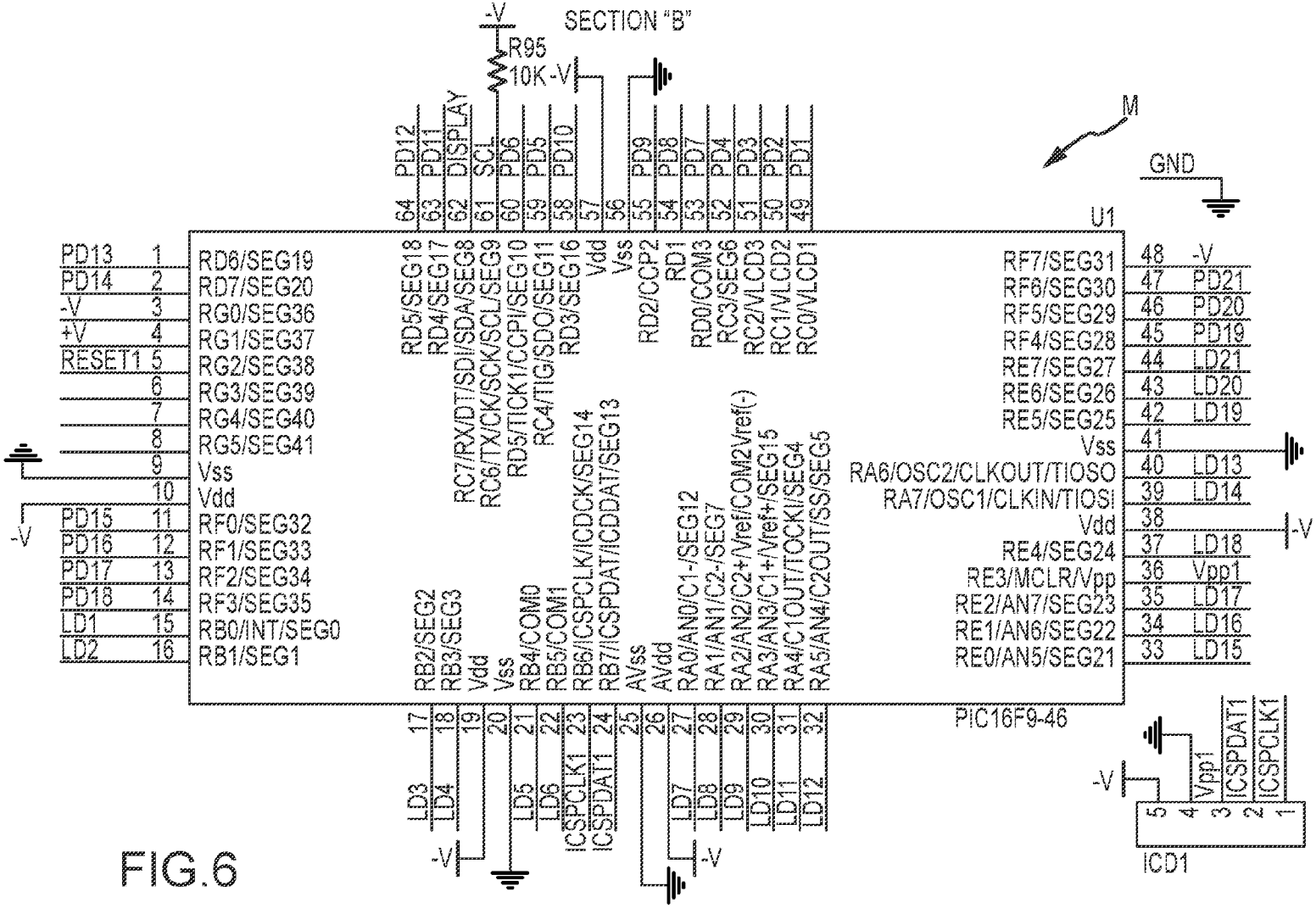
FIGS. 6-8 are close-up views of section "B"-"D", respectively, in FIGS. 41, 4F, and 4C, each showing a microcontroller used by the laser training target.
Figure 7:
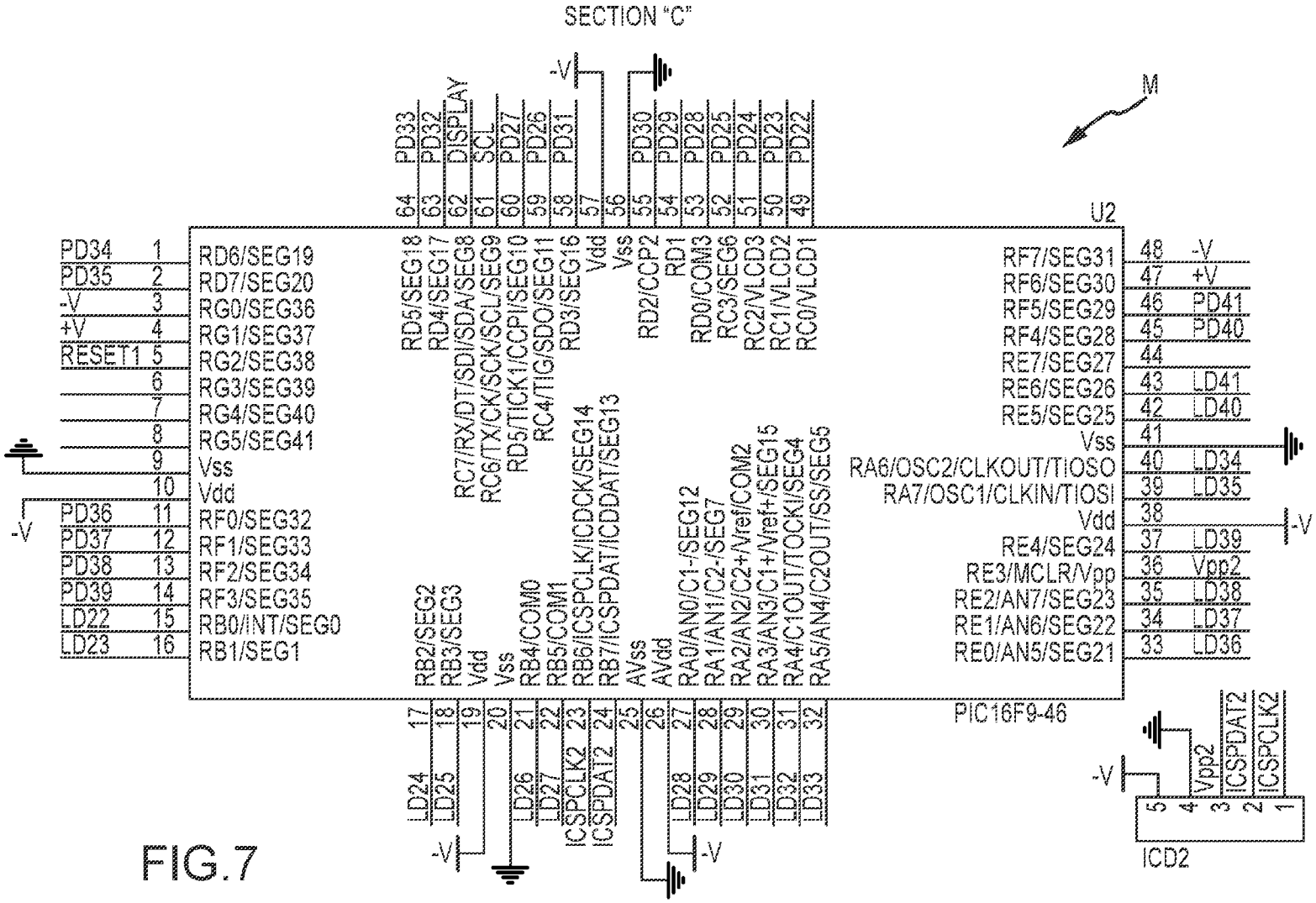
Figure 8:
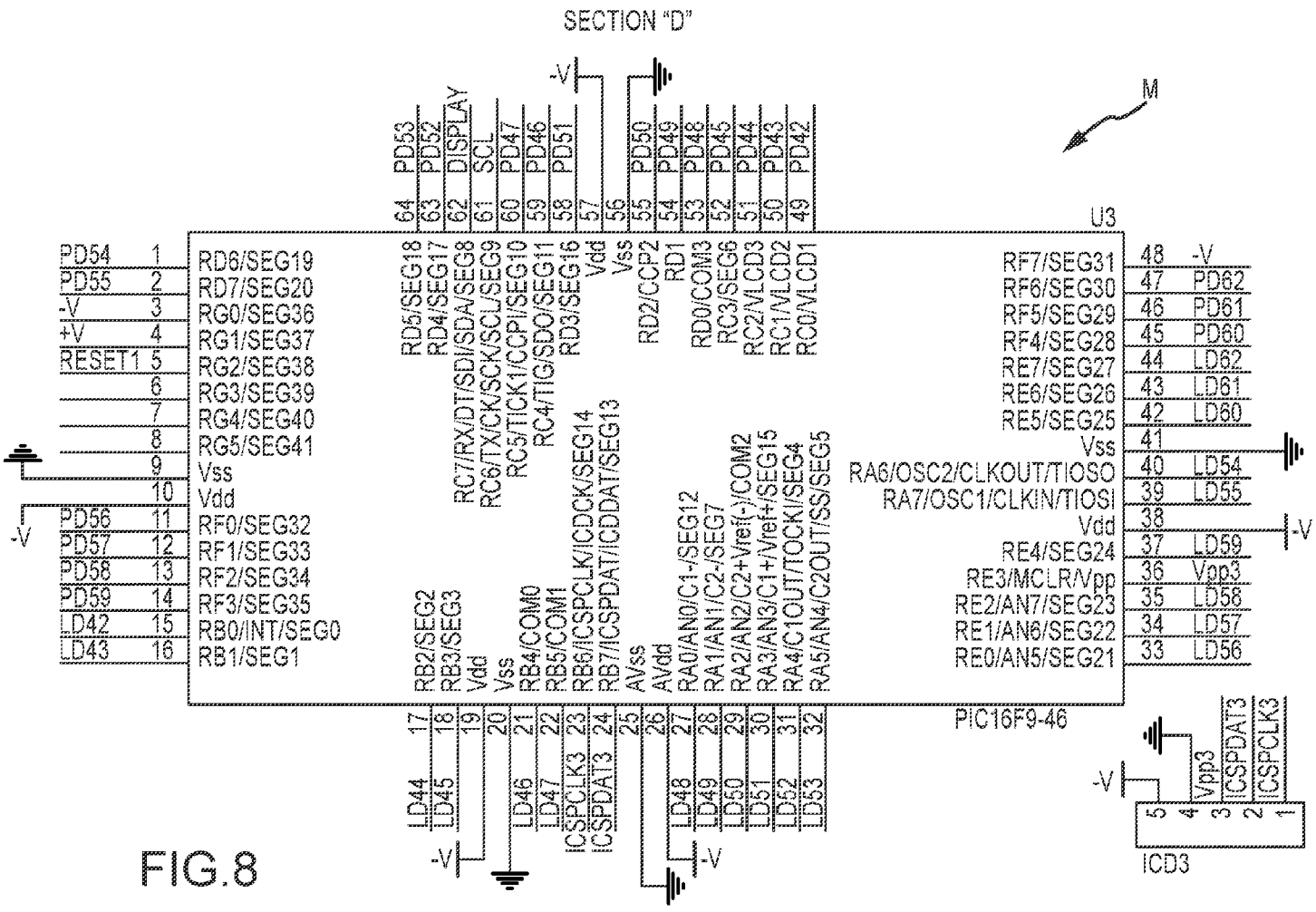
Figure 9:
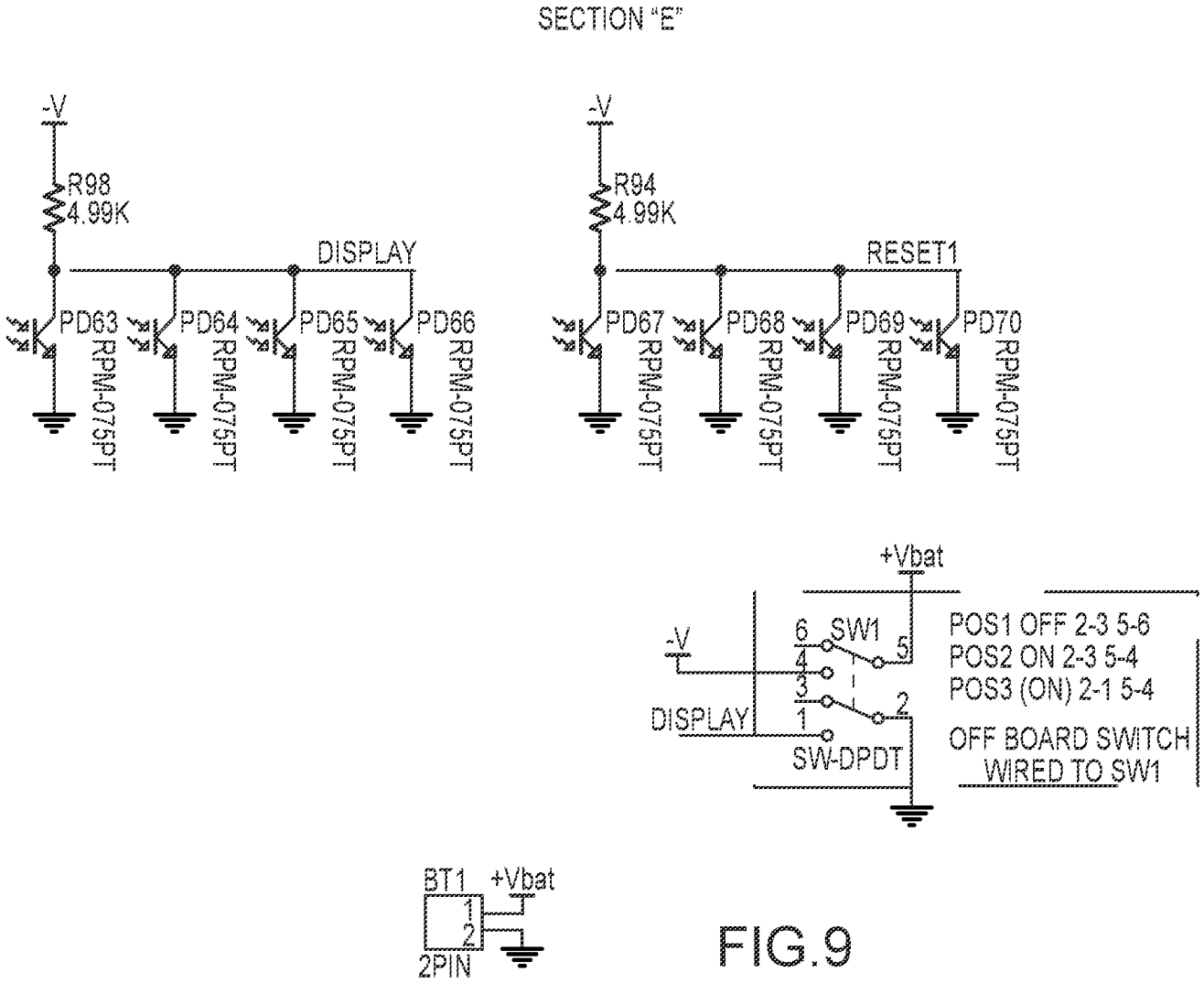
FIG. 9 is a close-up view of section "E" in FIG. 4B, showing the circuit diagrams for the "Display" and "Reset" portions of the laser training target.
Figure 10:
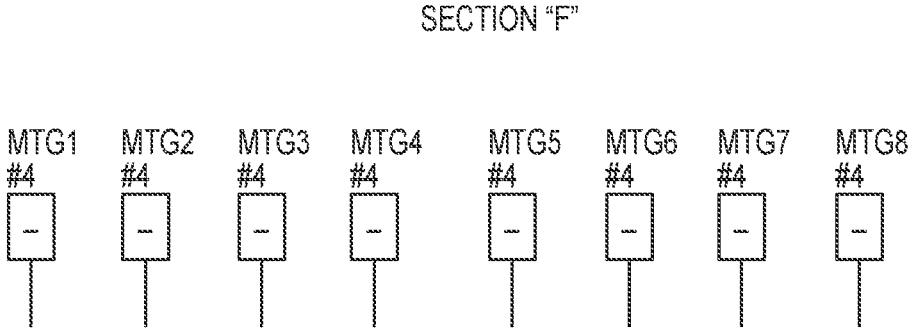
FIG. 10 is a close-up view of section "F" in FIG. 4D.
Figure 11:
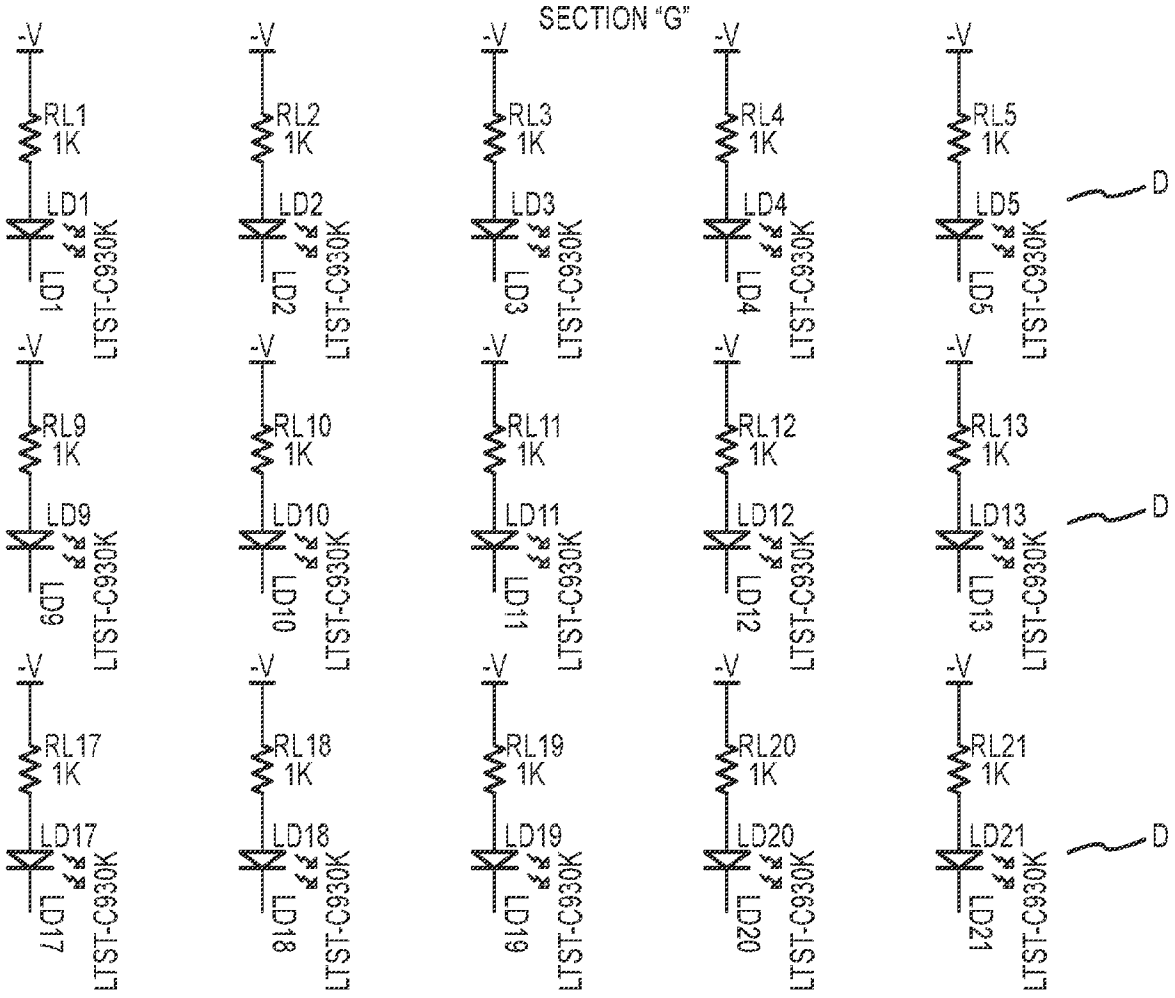
FIG. 11 is a close-up view of section "G" in FIG. 4J, showing the circuit diagrams for a portion of the light-emitting diodes used in the laser training target.

FIGS. 4A-AJ depict an exemplary circuit diagram of the laser trainer target shown in FIGS. 1-2. In this embodiment, the laser trainer target 10 includes 62 sensors S (the phototransistors shown in Section "A" of FIG. 5) and 62 optical displays D, which are preferably laser-activated LED lights (shown in Section "G" of FIG. 11). Detection of laser strikes and illumination of the optical displays D is controlled by three microcontrollers M (Sections "B," "C," and "D" in FIGS. 6-8, respectively). Section "E" of FIG. 9 illustrates the phototransistor sensors and switching used in the display and reset areas of the target 10.

Preferably, each sensor S and its corresponding optical display D are located in the same position (or very near to each other) behind the target screen 12 to show a laser hit as accurately as possible when the target 10 is in the display mode. A target of the present invention may be of any suitable size, shape and color. In the exemplary embodiment depicted in FIGS. 1 and 2, the screen 12 of the target 10, as well as the reset and display areas 18 and 20, are red in order to operate optimally with red laser light. A target of the present invention may include any desired number of sensor/optical display pairs, which may have any desired spacing. In the embodiment depicted here, there are 62 sensor/display combinations spaced about ½" apart. The target may also, for example, have sensor/display pairs spaced in a circular pattern spaced 1" apart expanding from the center of the target.

Preferably, only a single sensor/display pair is activated for each laser strike. In one embodiment, this can be accomplished by, for example: (a) only activating the display D corresponding to the sensor S that received the highest intensity laser light strike, and (b) delaying the activation of any other sensor/display pairs (which could be done by delaying the activation of one or more of the sensors and displays), by a predetermined amount of time, to avoid the target registering a single laser strike more than once. The predetermined delay is preferably long enough to not register a laser "dragged" across the target, but short enough to register hits from a person rapidly pulling the trigger on a firearm equipped with a laser-emitting device (such as a laser trainer cartridge). In one embodiment, there is a 25 ms delay between the permissible registration of laser strikes. During the delay the sensors S are deactivated from recording additional strikes.

In one embodiment, when a sensor S detects a laser strike, the strike is registered (either by the sensor or a microcontroller in communication with the sensor) until the reset function is activated. In some embodiments, multiple laser strikes upon the same sensor may be indicated by increasing the intensity of the light emitted from the optical display when the target 10 is in the display mode.

In one embodiment, the target may produce a sound (e.g., through a speaker) to indicate the target has been hit, as well as to indicate where on the target 10 the laser strike was registered. For example, one type of sound may be produced to indicate a "bulls-eye" while other sounds may be produced to indicate, respectively, a hit within each of the rings of the target.

The functionality of the laser training target 10 may be implemented using hardware, software, or combination of the two. In the exemplary target of FIG. 1, the microcontrollers M (FIGS. 6-8) execute instructions stored in a memory (either internal to the microcontroller M or external to the microcontroller M) to cause the processors to register laser strikes from the sensors S and illuminate the optical displays when the target 10 is in the display mode. As an alternative to the manual on/off switch 14 and display or reset areas 18 and 20 of the target 10, alternate embodiments of the target may be configured to interface to a remote control (e.g., a dedicated remote or application running on a device, such as a computer, in communication with the target) to perform various functions, including resetting the target, activating the display function of the target, turning the target on and off, adjusting an intensity level of one or more of the optical displays, and adjusting a volume level of one or more sounds produced by the target.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A target for sensing a laser light striking the target, the target comprising (a) a screen for allowing laser light to pass through it; (b) a plurality of sensors, each of the sensors for sensing when it has been exposed to laser light; and (c) a plurality of optical displays, at least one of the plurality of optical displays being associated with each of the sensors, each optical display capable of being activated to display on the target where the laser light struck the target.

2. The target of claim 1 that is battery powered.

3. The target of claim 1 that has a manual off-on switch.

4. The target of claim 1 wherein the target area that is circular in shape.

5. The target of claim 1 wherein each of the optical displays is a light emitting diode.

6. The target of claim 1 that has a display mode wherein each of the optical displays that is associated with a sensor that has been exposed to laser light illuminates when the display mode is activated.

7. The target of claim 6 wherein the display mode is activated by illuminating a display area on the target by a laser light.

8. The target of claim 1 wherein each sensor that is struck by laser light records the strike of laser light until the target is reset.

9. The target of claim 1 wherein each sensor is in electrical communication with an optical display located at the same relative position on the target as the sensor.

10. The target of claim 1 wherein the sensors are positioned ½" apart.

11. The target of claim 1 wherein the sensors are positioned in a circular pattern on circles spaced 1" apart expanding from the center of the target.

12. The target of claim 1 wherein only one sensor is activated for each laser light strike.

13. The target of claim 1 wherein a laser light strike on the target activates the sensor that senses the highest light intensity from the strike and the other sensors are deactivated with respect to that laser light strike.

14. The target of claim 1 wherein the target is configured to emit a sound when a laser strike is detected.

15. The target of claim 1 wherein a laser light strike on the target activates the sensor that senses the highest light intensity from the strike and the other sensors are deactivated with respect to that laser light strike.

16. The target of claim 1 wherein the sensors are deactivated for 25 milliseconds or more before reactivating.

17. The target of claim 1 wherein the target is configured to emit a sound when a laser strike is detected.

18. The target of claim 1 further comprising a remote control configured to control the target, wherein controlling the target includes one or more of:

resetting the target;
activating the display function of the target;
turning the target on;
turning the target off;
adjusting an intensity level of one or more of the optical displays; and
adjusting a volume level of one or more sounds produced by the target.

19. A target for sensing a laser light striking the target, the target comprising (a) a screen for allowing laser light to pass through it; (b) a plurality of sensors, each of the sensors for sensing when it has been exposed to laser light; (c) a plurality of optical displays, at least one of the plurality of optical displays being associated with each of the sensors, each optical display capable of being activated to display on the target where the laser light struck the target; and (d) wherein the sensors are activated for 25 milliseconds or more before being reactivated.

20. The target of claim 19 that is battery powered.

21. The target of claim 19 that has a manual off-on switch.

22. The target of claim 19 wherein each of the optical displays is a light emitting diode.

23. The target of claim 19 that has a display mode wherein each of the optical displays that is associated with a sensor that has been exposed to laser light illuminates when the display mode is activated.

24. The target of claim 19 wherein the display mode is activated by illuminating a display area on the target by a laser light.

25. The target of claim 19 wherein each sensor that is struck by laser light records the strike of laser light until the target is reset.

26. The target of claim 19 wherein each sensor is in electrical communication with an optical display located at the same relative position on the target as the sensor.

27. The target of claim 19 wherein the sensors are positioned ½" apart.

28. The target of claim 19 wherein the sensors are positioned in a circular pattern on circles spaced 1" apart expanding from the center of the target.

29. The target of claim 19 wherein only one sensor is activated for each laser light strike.

30. The target of claim 19 wherein a laser light strike on the target activates the sensor that senses the highest light intensity from the strike and the other sensors are deactivated with respect to that laser light strike.

31. The target of claim 19 wherein the target is configured to emit a sound when a laser strike is detected.

32. The target of claim 19 further comprising a remote control configured to control the target, wherein controlling the target includes one or more of:
resetting the target;
activating the display function of the target;
turning the target on;
turning the target off;
adjusting an intensity level of one or more of the optical displays; and
adjusting a volume level of one or more sounds produced by the target.

33. A target for sensing a laser light striking the target, the target comprising (a) a screen for allowing laser light to pass through it; (b) a plurality of sensors, each of the sensors for sensing when it has been exposed to laser light; and (c) a plurality of optical displays, at least one of the plurality of optical displays being associated with each of the sensors, each optical display capable of being activated to display on the target where the laser light struck the target; and (d) a remote control configured to control the target, wherein controlling the target includes one or more of:
resetting the target;
activating the display function of the target;
turning the target on;
turning the target off;
adjusting an intensity level of one or more of the optical displays; and
adjusting a volume level of one or more sounds produced by the target.

34. The target of claim 33 that is battery powered.

35. The target of claim 33 that has a manual off-on switch.

36. The target of claim 33 wherein each of the optical displays is a light emitting diode.

37. The target of claim 33 that has a display mode wherein each of the optical displays that is associated with a sensor that has been exposed to laser light illuminates when the display mode is activated.

38. The target of claim 33 wherein the display mode is activated by illuminating a display area on the target by a laser light.

39. The target of claim 33 wherein each sensor is in electrical communication with an optical display located at the same relative position on the target as the sensor.

40. The target of claim 33 wherein the sensors are positioned ½" apart.

41. The target of claim 33 wherein the sensors are positioned in a circular pattern on circles spaced 1" apart expanding from the center of the target.

42. The target of claim 33 wherein only one sensor is activated for each laser light strike.

43. The target of claim 33 wherein a laser light strike on the target activates the sensor that senses the highest light intensity from the strike and the other sensors are deactivated with respect to that laser light strike.

44. The target of claim 33 wherein the target is configured to emit a sound when a laser strike is detected.

* * * * *